United States Patent [19]

Gagnebin

[11] Patent Number: 4,529,323

[45] Date of Patent: Jul. 16, 1985

[54] LEAK RESISTANT WATCH CASING HAVING ANNULAR ELASTIC ELEMENT SURROUNDING A CASING RING WHICH CENTERS THE WATCH MOVEMENT RELATIVE TO THE CASING

[75] Inventor: Gaston Gagnebin, Bienne, Switzerland

[73] Assignee: Omega SA, Switzerland

[21] Appl. No.: 549,715

[22] Filed: Nov. 8, 1983

[30] Foreign Application Priority Data

Nov. 9, 1982 [CH] Switzerland ..... 6501/82

[51] Int. Cl.[3] ..... G04B 37/00

[52] U.S. Cl. ..... 368/291; 368/289; 368/300

[58] Field of Search ..... 368/287, 291, 292, 294–296, 368/309, 299, 300, 316

[56] References Cited

U.S. PATENT DOCUMENTS

| | | | |
|---|---|---|---|
| 2,256,200 | 9/1941 | Heilman | 368/289 |
| 3,643,424 | 2/1972 | Simon | 368/291 |

FOREIGN PATENT DOCUMENTS

| | | | |
|---|---|---|---|
| 447373 | 3/1948 | Canada | 368/291 |
| 1434497 | 3/1965 | France . | |
| 250010 | 5/1948 | Switzerland | 368/291 |
| 252164 | 9/1948 | Switzerland . | |
| 310877 | 1/1956 | Switzerland . | |
| 619345 | 9/1980 | Switzerland . | |
| 721920 | 1/1955 | United Kingdom | 368/287 |

*Primary Examiner*—Bernard Roskoski

*Attorney, Agent, or Firm*—Griffin, Branigan, & Butler

[57] ABSTRACT

A leak resistant watch casing is designed to accomodate a thin movement. It comprises a casing ring (7) supporting the movement (5) around which an elastic binding (10) is removably mounted. The binding is of rectangular cross section with the smaller sides of the rectangle being pressed against the case-band (1) and the back cover (11) when these elements are secured together. The binding includes an orifice (17) situated proximate two U-formed openings provided in the periphery of the case-band and back cover in order to accomodate the stem (15) of a control element.

4 Claims, 3 Drawing Figures

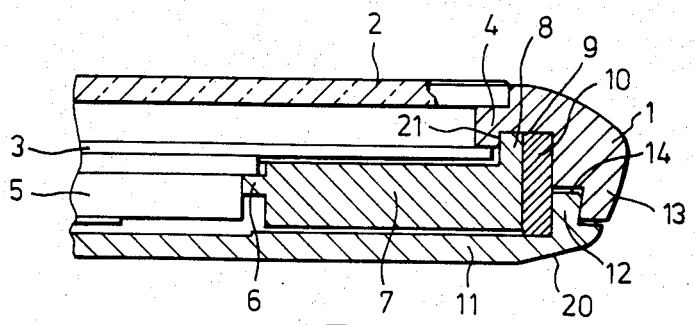
Fig. 1.
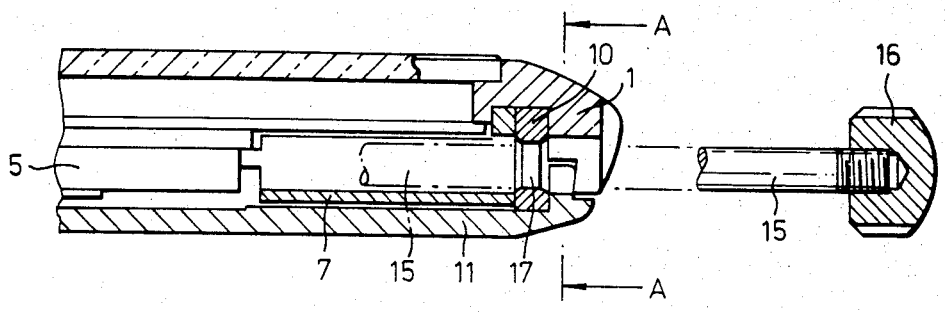
Fig. 2.
Fig. 3.
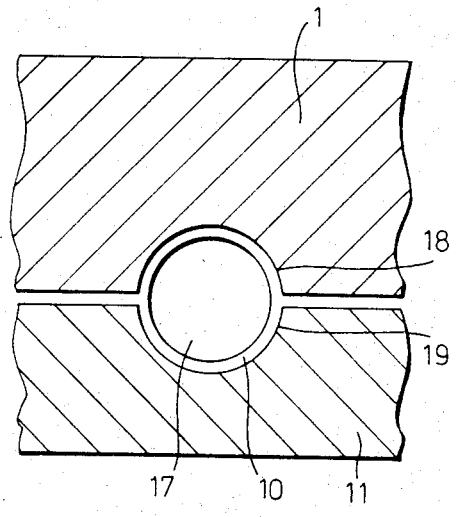

LEAK RESISTANT WATCH CASING HAVING ANNULAR ELASTIC ELEMENT SURROUNDING A CASING RING WHICH CENTERS THE WATCH MOVEMENT RELATIVE TO THE CASING

BACKGROUND OF THE INVENTION

This invention concerns a leak resistant watch casing designed to accomodate a thin watch movement and comprises a case-band bezel onto which a watch glass is sealed, a back cover snap mounted onto the case-band, a casing ring supporting the movement, an elastic binding of substantially rectangular cross section with a first large side of the rectangle mounted on the periphery of the casing ring and the two smaller sides pressing respectively against the case-band and the back cover when these elements are secured together.

Present day styling calls for watches having greatly reduced thickness and it is by no means rare to find movements mounted in these watches of which the thickness is on the order of a millimeter. Such a constraint in the miniaturisation requires the designer to turn away from classic solutions by far too cumbersome and find original solutions whether this be at the level of the components which form the movement or, as will be seen from the present, at the level of the casing itself.

A watch casing having a certain resemblance to that which is to be described hereinafter is known from Swiss Pat. No. 619 345 wherein the casing ring 7 is covered on its exterior by a sealing number 9 presenting two edges *9a* and *9b* which extend radially towards the interior and cover portions of the casing ring. This construction, as may be seen from the drawings relating thereto, has obviously not been intended for a thin watch. There will be noted in particular the substantial volume occupied by the edges *9a* and *9b* and above all the system by which the projections *7a* and *7b* of the frame are hooked onto the bulges *3b* and *4b* as exhibited respectively by the case-band bezel 3 and the bottom cover 4, this system being impracticable on a frame of which the thickness would be on the order of a millimeter.

Swiss Pat. No. 310 877 concerns a leak resistant and shock resistant watch-case characterized in that it comprises a casing ring formed by a metallic ring surrounded by a binding of plastic material which is compressible, this binding presenting an exterior edge which is pressed against the case-band by a closing member for the case. This construction relates to a watch of substantial dimensions wherein the binding is mounted in such a fashion that the movement floats within the casing. Such cannot be suitable for watches of small dimensions as currently used where such a construction would prevent a miniaturisation of the assembly, notably by the edge of the binding which inevitably increases the diameter of the finished product. It will further be noted that the cited construction by definition will not permit a precise centering of the movement in the case, and hence is not suitable for a watch at the top range of quality.

U.S. Pat. No. 2,256,200 likewise concerns a shock resistant watch and where consequently the centering of the movement relative to the casing is totally lacking in precision. Moreover it will be noted that the bottom cover is adjusted onto a one piece casing on the interior of which may be supported the elastic binding. This construction in no manner permits the provision of an exterior cut-away on the periphery of the back cover in order to give the assembled timepiece an even thinner aspect as will appear from the present invention. In order that this be possible, it would be necessary that the separation between the back cover and the case be realized at a place where the exterior perpiphery of the binding would cover said separation.

In order to overcome the preceding difficulties there has been proposed in Swiss application No. 631 045 G a watch casing design which may be applied to an extra thin watch. To this end the application discloses a casing ring formed by a metal plate 1 overmoulded by an elastic material 10 while the back cover 5 and the case-band 6 are snapped together. Thus, in this design, the thickness of the overmoulded plate 12 is small and less than two mm. Such a solution however necessitates an overmoulding which, on the one hand, can only be obtained onto a metal plate and, on the other hand, requires that there be provided as many overmoulded components as there are varieties of casing.

Thus, the present invention proposes to overcome the difficulties as cited above by providing a new design provided with means which will appear from the claims.

BRIEF DESCRIPTION OF THE DRAWINGS

FIG. 1 is a cross section at 9 o'clock in the sense of the watch thickness.

FIG. 2 is a cross section at 3 o'clock in the sense of the watch thickness.

FIG. 3 is a cross section along line A—A of FIG. 2 at a doubled scale.

DETAILED DESCRIPTION OF THE INVENTION

FIG. 1 shows how a timepiece according to the invention may be assembled. Onto the case-band bezel 1 is mounted in a sealed manner a watch-glass 2. In order to reduce as much as possible the thickness of the timepiece it is preferred to glue the glass into a notch arranged in the periphery of the case-band. It is however clear that other solutions are possible which may for instance make use of a sealing ring interposed between the case-band and the glass. The glass 2 and the dial 3 are separated by flange 4 which forms part of the case-band 1. Movement 5 is maintained in place by a peripheral tongue 6 of a casing ring 7. Such casing ring bears as well a raised rim 8 which engages with a groove 9 provided in the interior portion of the case-band. Rim 8 is centered in groove 9 by shoulder 21. An elastic binding 10 is mounted onto the periphery of casing ring 7 as surmounted by the raised rim 8 and is also engaged in the groove 9. Bottom cover 11 is engaged with case-band 1 by means of two catch formed portions 12 and 13 and, when the watch is assembled, binding 10 takes on the form of a rectangle such as shown in the figure. The first large side of this rectangle contacts casing ring 7 and the second large side covers the gap 14 formed by the case-band 1 and bottom cover 11. The sealing is assured by the small sides of the rectangle which are respectively pressed against groove 9 and the interior wall of bottom cover 11. It will be understood that the height of binding 10, prior to assembly into the timepiece, exceeds slightly (0.1 to 0.2 mm) the height of the empty space between the case-band and the bottom cover in order to permit at the time of assembly the crushing of the binding and thus the assurance of good sealing.

FIG. 2 concerns the same components which have been discussed in respect of FIG. 1 and shows additionally how the watch control stem is mounted. A stem 15, provided with a crown 16, passes through the case, the elastic binding 10, the casing ring 7 and then is coupled to the mechanism of the movement 5. An orifice 17 is pierced through binding 10 the diameter of said orifice being slightly less than that of the stem diameter. By this means one assures good sealing at the place where the stem passes through if in addition care is taken to polish the stem at the same place.

Since the overall thickness of the assembled case is greatly reduced, generally there is insufficient material to fit a guide tube for the stem. FIG. 3, which is a cross section along line A—A of FIG. 2, shows that the case-band 1 and bottom cover 11 are each provided with an opening 18 and 19 in the form of a U the opened branches of which face one another. The orifice 17 of binding 10 is thus found in the line of the U-formed openings. The absence of a guide tube has the advantage of avoiding the necessity of an extra sealing joint which is generally required in every system of this type.

The construction which has just been described is suitable for watch-cases whether round or of other forms. In the case of a round case, the casing ring 7 may be in metal while it is preferably realized in plastic material should one be concerned with a case having another form. Generally the elastic binding 10 will be fixed in a detachable manner to the casing ring somewhat in the same fashion as a tire mounted on its rim.

Thus the elastic binding such as has been described enables a considerable reduction of the thickness of the watch since it consists of a simple and single surrounding portion having a rectangular form of small volume and which assures at the same time a sealed mounting of the bottom cover onto the case-band and a sealed passage for the control stem. As may also be seen, this construction facilitates the providing of an exterior cut-away 20 on the periphery of the bottom cover, this latter contributing to give the assembled timepiece an aspect which is that of a still thinner timepiece.

It should also be noted that the described construction simplifies the assembly operations: having mounted glass 2 onto the case-band 1, one may introduce from below the assembly formed by dial 3, movement 5 and casing ring 7 with its binding 10 and thereafter the stem 15 may be mounted in place and the casing is closed with the bottom cover 11.

What I claim is:

1. A leak resistant watch casing designed to accomodate a thin watch movement and comprising a case-band bezel onto which a watch glass is sealed, a back cover snap mounted onto the case-band bezel, a movement, a casing ring supporting the movement, an elastic binding of substantially rectangular cross section with a first large side of the rectangle mounted on the periphery of the casing ring and the two smaller sides pressing respectively against the case-band bezel and the back cover when these elements are secured together wherein the casing ring includes a raised rim portion arranged and adapted to engage with a groove provided in the interior of the case-band bezel, said rim portion being urged against a shoulder bounding the groove in order to center the movement relative to the casing and the second large side of the rectangle forming the binding cross section covers the separation gap between the case band and the back cover.

2. A leak resistant watch casing as set forth in claim 1 wherein the case-band bezel and the back cover are each provided on their respective peripheries with a U-formed opening the openings being arranged to face one another, the binding having an orifice arranged in line with the proximate said openings so as to accomodate a control stem mounted without a guide tube, said orifice having a diameter less than that of the stem.

3. A leak resistant watch casing as set forth in claim 1 wherein the elastic binding is fixed in a detachable manner to said casing ring.

4. A leak resistant watch casing as set forth in claim 1 wherein one of the smaller sides of the rectangle forming the binding cross section is pressed against a groove provided in the case-band.

* * * * *